US007210410B1

(12) United States Patent
Widener

(10) Patent No.: US 7,210,410 B1
(45) Date of Patent: May 1, 2007

(54) MULTI-PROJECTILE LESS LETHAL AND BREACHING AMMUNITION

(76) Inventor: Charles D. Widener, 2701 W. Boom Rd., Searcy, AR (US) 72143

( * ) Notice: Subject to any disclaimer, the term of this patent is extended or adjusted under 35 U.S.C. 154(b) by 20 days.

(21) Appl. No.: 11/277,892

(22) Filed: Mar. 29, 2006

(51) Int. Cl.
*F42B 8/00* (2006.01)

(52) U.S. Cl. ..... 102/502; 102/438

(58) Field of Classification Search ..... 102/502, 102/444, 529, 435, 438; 42/95
See application file for complete search history.

(56) References Cited

U.S. PATENT DOCUMENTS 3,906,859 A * 9/1975 Smith ..... 102/444
5,295,439 A * 3/1994 Carbone ..... 102/438
5,648,637 A * 7/1997 Clark, III ..... 102/438
5,652,407 A * 7/1997 Carbone ..... 102/438
6,782,828 B2 * 8/2004 Widener ..... 102/502
2005/0252405 A1 * 11/2005 Deskins ..... 102/529

* cited by examiner

*Primary Examiner*—Michelle Clement
*Assistant Examiner*—Benjamin P. Lee
(74) *Attorney, Agent, or Firm*—Kleinberg & Lerner, LLP; Marvin H. Kleinberg; Marshall A. Lerner

(57) ABSTRACT

A cartridge includes a segmented elastomeric projectile and associated motion transfer member. The motion transfer member includes a cutting surface to separate the projectile segments when deployed. In a preferred embodiment, a cartridge includes a plurality of segmented elastomeric projectiles, each with its own motion transfer member. A piston element which is deployed by expanding gases, includes a force transfer element which engages an overlying motion transfer member which, in turn, engages its overlying transfer member. As each transfer member engages an overlying transfer member, its projectile is severed into its constituent segments.

14 Claims, 1 Drawing Sheet

MULTI-PROJECTILE LESS LETHAL AND BREACHING AMMUNITION

CROSS REFERENCE TO RELATED APPLICATIONS

U.S. Pat. No. 6,782,828 B2 is relied upon for additional disclosures.

STATEMENT REGARDING FEDERALLY SPONSORED RESEARCH/DEVELOPMENT

Not Applicable

REFERENCE TO MICROFICHE APPENDIX

Not Applicable

BACKGROUND OF THE INVENTION

1. Field of the Invention

The present invention relates to special purpose shot gun ammunition for use by law enforcement and the military and to methods for discharging multiple pliant projectiles reliably and very effectively from weapons. In particular, the present invention provides the ability to discharge a multiplicity of either less lethal or breaching projectiles from weapons at elevated levels of kinetic energy while minimizing the risk of both lethality and collateral damage.

2. Description of the Related Art

In the field of 12 gauge shotgun rounds there exists two general categories, especially in less lethal ammunition. The first is referred to by the military as a "point" cartridge or round. This round employs a single projectile and is directed toward and intended to deter a single or individual target. Significant improvement in this technology is disclosed in a related U.S. Pat. No. 6,782,828 B2, of the present inventor, which discloses novel techniques for discharging unitary less lethal or breaching projectiles from weapons.

The second type of cartridge or round is referred to as an "area" round. This round has multiple projectiles and is intended for use against multiple targets or personnel such as might be employed to quell an unruly crowd or a riot. Presently, the universal choice for the "area" cartridge has been rubber buckshot. The rubber buckshot round has approximately 10–12 hard rubber buckshot pellets that are from 60 to 90 Shore "A" in Durometer hardness, enclosed in a standard 12 gauge shotgun shell. That level of hardness is required to enable the rubber pellets to pass safely thru the barrel of the weapon.

SUMMARY OF THE INVENTION

Recently, the United States Marine Corps. initiated a search for what might be considered the next generation of "area" cartridges, as there had been dissatisfaction with the rubber buckshot "area" round currently available. Based upon the technology disclosed in the above mentioned application for patent, a design for a greatly improved "area" cartridge has evolved, employing some of the principles incorporated in a pending pliant firearms projectile patent application and adding some unique and novel features not heretofore found in a less lethal area cartridge.

The design of the present invention results in a cartridge with over twice the number of projectiles, twice the total payload and a much higher muzzle velocity while still maintaining the proper levels of kinetic energy and kinetic energy density delivered onto the target body surface. These improvements result from the use of a very low Durometer hardness projectile material that may be "filled" with a metallic powder, the unique positioning of the projectiles and the novel application of the force of the expanding gas on them.

According to the present invention, a projectile cluster includes a plurality of projectiles joined together by a thin web. Associated with each cluster is a motion transfer member, which includes a base disc and a center post. The center post has, at its forward end, a cutting surface, which, in cooperation with an overlying disc, is adapted to sever the web that connects the projectiles of the cluster.

A plurality of such projectile clusters, each with its motion transfer member are stacked in a shotgun shell and rest upon a piston disc. The shotgun shell includes a primer and a powder charge below the piston disc. A top or sealing wad is crimped in place over the stacked projectile clusters.

In operation, the primer ignites the powder charge. The powder charge, as it burns, produces expanding gases, which act to propel the piston forward. The piston engages the base disc of the lowermost projectile cluster and moves the base disc and its associated motion transfer rod. As the transfer rod moves forward, its cutting surface encounters the web connecting the projectiles of the cluster and in cooperation with the overlying disc, severs the web, separating the projectiles of the cluster. The projectiles of the uppermost cluster are separated by the action of the transfer rod in cooperation with the sealing wad which is crimped in place.

As the first projectile cluster group moves forward, the transfer rod engages the base disc of the next projectile cluster, urging its transfer rod forward to sever the web of its associated projectile cluster group. This process continues as each projectile cluster engages the projectile cluster above it and the respective transfer rods sever the cluster webs until all clusters are moving together with the top wad, into the barrel of the shotgun, all under the driving influence of the expanding gas acting upon the piston.

As the projectile clusters exit the shell casing, all of the projectiles are now independent of each other. However, the clusters remain together as they traverse the gun barrel and separate only as they clear the muzzle of the gun. As the clusters are deployed to the target, they disperse and the discs and associated transfer members, on encountering more air resistance, slow down and separate from the projectiles, which continue to the target.

In an alternative embodiment, the second type or breaching round, the same overall structure is employed, including the projectile clusters and associated base discs and motion transfer members. While the same or similar elastomer material is employed for the breaching round, it is "saturated" with copper particles as described in the abovementioned patent. Because each projectile cluster has a greater mass in the breaching round, it is also necessary to increase the powder charge to achieve the required muzzle velocity.

The overall object of this invention is to develop a universal round that by changing only the projectile material, can serve either as a less lethal round, or a breaching round for forced entry. Another object of the invention is to provide a less lethal "area" round that will be effective as a crowd control cartridge at from 15 to 45 yards. Still another object of the present invention is to offer a "point" round that can provide actual "knock down" power without lethality when directed at a single target body at a range of from 5 to 10 yards. This seemingly contradictory requirement is now feasible according to the present invention because the significant kinetic energy available from the combined projectiles is dispersed over a multiplicity of impact points over a large surface area of a single target body.

An additional object of this invention is to provide a round that can quickly remove automobile windows and double paned building windows and doors without lethality or collateral damage to the occupants of the automobile or building. Still another object of this invention is to provide a capability for breaching by removing door locks, bolts and hinges with a single shot without any danger of collateral damage to occupants or other parts of the structure.

An additional object of this invention is to provide a method for successfully terminating vehicle pursuits by providing a round that can seriously compromise the radiator of a fleeing vehicle, guaranteeing a safe, controlled, but inevitable failure of the vehicle engine, without danger to bystanders or to the driver.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DETAILED DESCRIPTION OF THE INVENTION

Figure 1:
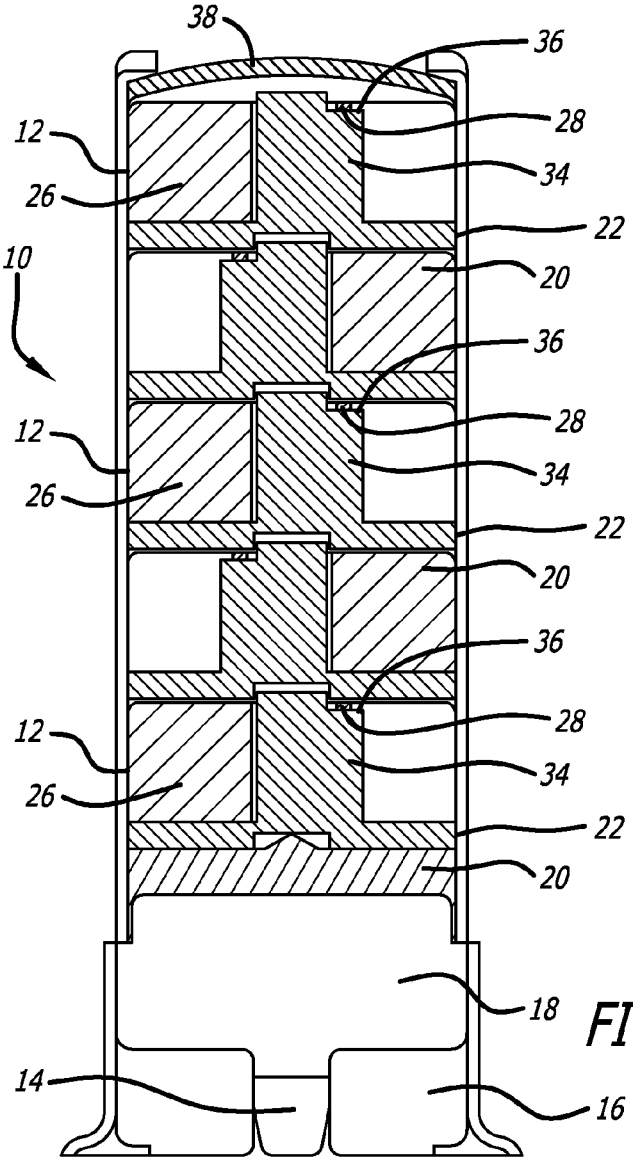
FIG. 1 is side sectional view of a cartridge according to the present invention.
Figure 4:
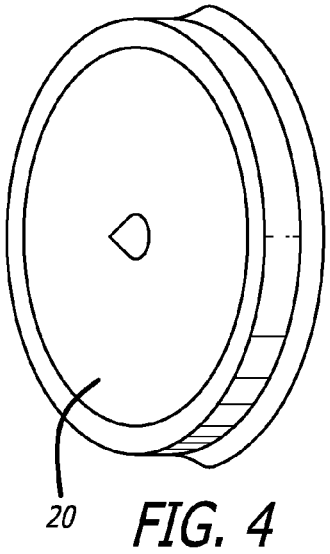
FIG. 4 is a perspective view of a piston.

FIG. 1 is a side sectional view of a cartridge or round 10 according to the present invention. A standard shot gun shell casing 12 is shown which includes a primer 14 and a base wad 16. A charge of smokeless powder 18 is placed upon the base wad 16. A piston 20 rests upon the powder charge 18 that, upon ignition, forces the piston 20 forward.

The piston 20 is in intimate contact with the first of a series of motion transfer members 22, each of which supports a projectile cluster 24. In the preferred embodiment, each projectile cluster 24 is made up of five individual projectiles 26 that are attached to each other on the upper surface by a thin narrow web member 28 of the same material as the projectiles 26. This thin narrow web member 28 serves to hold the individual projectiles 26 together when they are ejected from an injection or compression mold (not shown) and further serves to facilitate the handling and loading of the cluster 24 into the shell casing 12, during assembly.

A motion transfer member 22 is made up of thin base disc 30, a center post 32 and, in this embodiment, five thin support members 34 that radiate from the center post 32. The uppermost end of each of the radiating support members 34 is a sharp edge 36 that acts in conjunction with the base disc 30 of the next motion transfer member 22, as a guillotine, which severs the web members 28 holding the individual projectiles 26 together in the projectile cluster 24.

Either during the final assembly process of compressing the internal components of the shot shell together for crimping a top or sealing wad 38 in place, or during the ignition of the powder charge 18, which violently compresses all of the components together during firing, the web members 28, which are positioned between the sharp edge guillotine 36 and the base disc 30 of the adjacent motion transfer member 22 are all severed, allowing the projectiles 26, upon exiting from the barrel of the weapon, to freely disperse. The uppermost transfer 22 severs its associated web member 28 by acting against the crimped top sealing wad 38.

Figure 2:
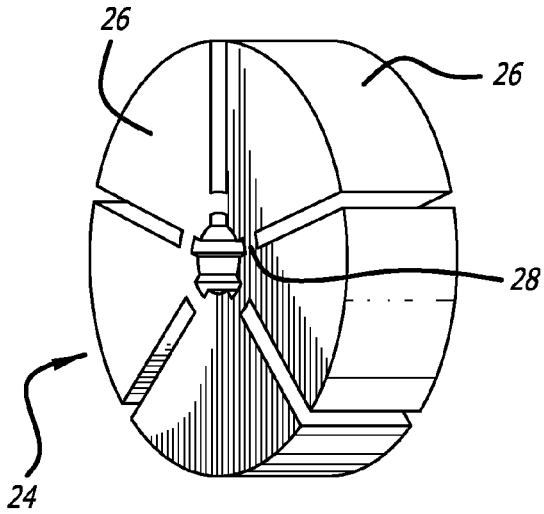
FIG. 2 is a perspective view of a single projectile cluster showing a web member connecting the individual projectiles.

The projectile cluster 24 comprising a plurality of projectiles 26, held together by a web member 28, is more clearly illustrated in FIG. 2. As shown, the web member 28 is at the inner end of the projectiles 26 and serves to hold the projectiles 26 together during handling. Because the web member 28 is thin, it is easily severed by the sharpened edge 36 in cooperation with next motion transfer member 22.

Figure 3:
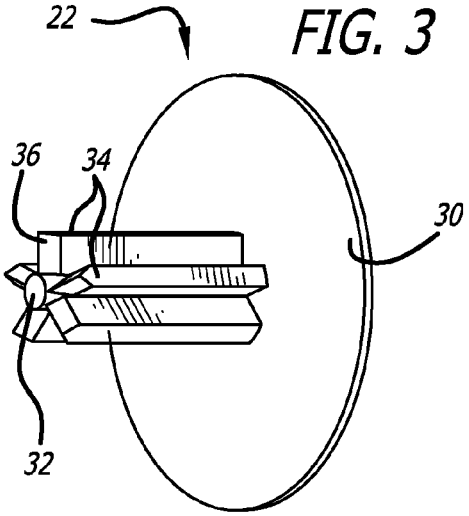
FIG. 3 is a perspective view of a transfer motion member.

As shown in FIG. 3, motion transfer member 22 is shown in greater detail. A base disc 30 includes a center post 32 which has a plurality of radially extending spacers 34. Each of the spacers 34 has, as an upper surface, a sharp edge 36 which functions to sever the web member 28. The center posts 32 on the motion transfer members 22, are aligned and indexed to one another. The base disc 30 of the initial motion transfer member 22 is aligned with and indexed to the piston 20.

Upon ignition of the powder charge 18, the piston 20 moves forward, compressing all of the center posts 32 together, in turn, eventually overcoming the inertia of the total payload, which, in the preferred embodiment includes five projectile clusters 24 of five projectiles 26, each. Because of some limited deflection under acceleration of the pay load, each base disc 30 will see, momentarily, some additional load from the payload in front of it, but unlike the center post 32 whose loading is accumulative, the base disc 30 loading is theoretically limited to one projectile cluster 24. Because each post 32 encounters a base disc 30, the clusters 24 are not compressed sufficiently to expand radially and therefore do not interfere with the smooth passage of the payload through the weapon barrel.

As noted above, when the sharp edges 36 of the support members 34 encounter the web member 28, if inertia in an overlying disc 30 keeps it from moving, then the motion of the base disc 30 will be sufficient to cut the web member 28. After the web member 28 is cut and the motion transfer assembly continues its forward motion, the inertia of the next base disc 30 will allow the web member 28 of the next cluster 24 to be severed. By the time all of the motion transfer members 22 are moving together, all of the web members 28 will have been severed, including the web member 28 of the uppermost cluster 24 whose web members are severed by the action of the transfer member 22 against the crimped top wad 38. Because there is little or no compression of the clusters 24, there is minimal radial expansion of the clusters 24 so that the pay load, including the separated projectiles 26 and the motion transfer members 22 continue to traverse the gun barrel without interference and exit smoothly.

The projectiles 26, together with the motion transfer members 22 will proceed toward the target in free flight. However, the greater surface area of the motion transfer members 22 and the base discs 30, in particular, causes some tumbling and diversion from the path to the target. Occasionally, there is some interaction between the projectiles 26 and the launching and deploying elements. Sometimes, this interaction tends to disperse the moving projectiles 26 but rarely has the effect of materially altering their trajectory or path to the target body.

Although the less lethal "area", round technology was originally conceived for applications dealing with multiple targets (riots or crowd control), if the round is used between a range of 15 to 30 feet or where it is determined that the projectiles 26 are assured to have substantially separated from one another, this round may be extremely effective as a "point" cartridge for an individual target.

In the less lethal version, with approximately 350 grains total payload weight and at approximately 950 feet per second velocity, the kinetic energy available on a single target body will be an impressive 700 ft. lbs, with the 25 individual projectiles 26 each contributing approximately 28 ft. lbs. This provides dramatic "knock down" power at impact, yet is less lethal when it is distributed over a large area of approximately one square foot of target body surface, depending upon the range to the target body.

Due to the very soft metal powder "filled" elastomer compound (20–25 Shore "A"), the total projectile area (foot print), of all 25 projectiles 26 at impact (at a terminal velocity of 650 fps) is estimated at 2.64 sq. in. which provides an optimum ≈110 ft. lb/sq. in. kinetic energy density onto the target body surface.

In the alternative embodiment breaching round, if a similar soft-elastomeric compound is "filled" instead with copper granules or other weighty metal granules for greater density, then the same basic round becomes a very effective breaching device or forced entry round.

It should be noted that the identical motion transfer member 22 and piston 20 can be used in either the less lethal or in the breaching configuration, even though the breaching unit has over two times the projectile weight (1.75 oz) in the preferred embodiment, and over two times the charge weight of powder is employed. The compressive load carrying capability of the more dense breaching projectile, is much greater than the softer, less lethal projectile. As a result, the design of the less lethal motion transfer member 22 with regards to rigidity and resistance to bending during firing is also adequate for use in the breacher round.

Testing of the breaching version at 950 ft. per second muzzle velocity, produced 1400 ft. lbs of kinetic energy, more than adequate to remove door locks, bolts and hinges from their supporting structure with a single round. By way of comparison, the weight of the individual projectile in the breaching round is approximately 28 grains as compared to approximately 13 grains for the less lethal projectile. Total breaching projectile weight is 1.75 oz. vs. 325 grains, (¾ oz.) for the less than lethal projectile.

Law enforcement has long sought a safe method of stopping a fleeing vehicle. In tests, firing breaching rounds at the radiator of an automobile resulted in the highly successful destruction of multiple radiator cores. This resulted in an almost complete loss of coolant, thus disabling the vehicle by overheating the engine in a preferred, controlled manner with no collateral damage to a driver or bystanders.

Similarly, it has been found necessary from time to time to remove an opaque or at least heavily tinted glass partition through which observation was difficult if not impossible. Depending on the size and thickness of the glass installation, either the less lethal or the breaching round may be successfully used. Testing on automobile side windows which were heavily tinted with film, a custom favored by some suspects, was highly successful. At a range of six yards, one shot with the less lethal round instantaneously removed the entire window with no collateral damage to the interior of the vehicle or its occupants. This test was as verified by the use of a "witness board" installed in the front seat area.

Large, double pane building safety glass panels may be removed with a single breaching round if delivered at a range of from 8 to 10 yards. Automobile windshields can be taken out with either the less lethal round or the breaching round, depending upon the range to the target. At very close ranges, the less lethal round can be effective while at longer ranges, the breaching round may be required.

The multi-projectile round disclosed herein consists of a multiplicity of projectile clusters each comprised of multiple, separable projectiles. When adapted to function either in a less lethal or breaching mode, the present invention can provide shotgun cartridges with wide capabilities in both the military and law enforcement environments, ranging from riot or crowd control at ranges of 10 to 50 yards, to the first, less lethal round with genuine target "knock down" capability without lethality from 5 to 10 yards. A shotgun cartridge, according to the present invention can also inflict lethal or near lethal trauma, dependant upon impact area, to stop a persistent attacker inside 10 feet. The entire less lethal universe can be accommodated with this single round.

In its breaching configuration, the same shotgun round will defeat door locks, bolts and hinges with a single shot. The breaching round will also slowly disable automobile engines with one shot thru the radiator with no collateral damage. If heavier glass plate or aluminum frame glass doors such as might be installed in commercial buildings are encountered, the breaching round is more applicable. Automobile windshields may require the extra momentum supplied by the breaching round to destroy them, dependent upon the range to the target.

As these rounds become more widely used, many additional applications will be found for this truly universal ammunition. The foregoing should be considered enabling rather than limiting and it will occur to others in the art how the rounds of the present invention can be adapted and modified for yet additional uses. Accordingly, the scope of the invention should be limited only by the scope of the claims appended hereto.

What is claimed is:

1. For use with a firearm, an ammunition round having a powder charge which, when ignited, generates expanding gases comprising:

a) two or more projectile bodies of a soft elastomeric material, each of said projectile bodies having disk shape and a central void; wherein each of said projectile bodies is comprised of a plurality of segments joined adjacent to said central void by a relatively thin web element;

b) a piston member, having a face surface and a force transfer element, mounted adjacent the powder charge, said piston member being adapted to be displaced by the expanding propellant gases of the ignited powder charge; and c) two or more motion transfer members each having a projectile body support surface and, on one side of said surface, an area adapted to be engaged with said piston force transfer element and, on the other side, a projecting element adapted to be received in said central void, said projecting element being adapted to engage an overlying motion transfer member;

whereby ignition of the powder charge creates expanding gases initially deploy said piston, said piston force transfer element engages the overlying motion transfer member to bring said transfer member through said interior of said projectile body into contact with an overlying motion transfer member causing each said motion transfer member to engage an overlying transfer member until said piston, under the influence of the expanding gases deploys all of said projectile bodies out of the weapon.

2. The ammunition round of claim 1 wherein each of said projectile bodies includes an indentation in each of said web elements and each of said motion transfer element projecting elements has rib elements adapted to fit in said indentations.

3. The ammunition round of claim 1 wherein each of said motion transfer element projecting elements has a sharpened end adapted to sever said relatively thin web elements when engaged and deployed by the action of said piston member.

4. The ammunition round of claim 1 wherein the lower surface of each projectile body rests upon its motion transfer member and said web element is in the upper surface of said projectile body and each of said motion transfer element projecting elements has a sharpened end adapted to sever said relatively thin web elements when engaged and deployed by the action of said piston member to contact the overlying motion transfer member.

5. The ammunition round of claim 3 wherein each of said projectile bodies has dense particles incorporated therein to increase the mass thereof.

6. For use with a firearm, a pliant projectile cartridge including, in combination:

a) a piston element adapted to be deployed by expanding gases from an ignited powder charge, said piston element having a face surface intended to be assembled adjacent a powder charge and, on the opposite face surface, a force transfer element;

b) a substantially disk shaped pliant projectile body including a central void and a plurality of segments radiating from said central void, each of said segments being joined together at said central void by a relatively thin web element; and c) disk shaped motion transfer means including, a piston facing surface and, at the other surface, an elongation adapted to fit into said projectile body central void, said elongation having a plurality of ribs, each being adapted to fit between said disk segments, each of said ribs terminating in a cutting surface;

whereby said cutting surfaces sever said web elements when said piston element is deployed and engages said motion transfer means.

7. The pliant projectile cartridge of claim 6 wherein said projectile body has a Shore "A" Durometer value between 20 and 40.

8. The pliant projectile cartridge of claim 6 wherein said projectile body has a Shore "A" Durometer value greater than 10.

9. The pliant projectile cartridge of claim 6 wherein said projectile body has a Shore "A" Durometer value less than 80.

10. The pliant projectile cartridge of claim 6, wherein said projectile body has dense particles incorporated therein to increase the mass thereof.

11. The pliant projectile cartridge of claim 10 wherein said projectile body is saturated with metallic particles selected from the group including copper, brass, bronze, iron, bismuth, lead and tungsten to increase the projectile body mass.

12. The pliant projectile cartridge of claim 6, further including more than one pliant projectile body and motion transfer means supporting each of said pliant projectiles, whereby a first pliant projectile and associated motion transfer means overlies said piston element and each succeeding pliant projectile and associated motion transfer means overlies a preceding pliant projectile and associated motion transfer means.

13. The pliant projectile cartridge of claim 12 wherein each of said projectile bodies has a Shore "A" Durometer value less than 80.

14. The pliant projectile cartridge of claim 12, wherein each of said projectile bodies has dense particles incorporated therein to increase the mass thereof.

* * * * *